United States Patent [19]

Tooch

[11] Patent Number: 4,606,529

[45] Date of Patent: Aug. 19, 1986

[54] FURNACE CONTROLS

[75] Inventor: Charles A. Tooch, Moon Township, Allegheny County, Pa.

[73] Assignee: Davy McKee Equipment Corporation, Pittsburgh, Pa.

[21] Appl. No.: 658,708

[22] Filed: Oct. 9, 1984

Related U.S. Application Data

[63] Continuation-in-part of Ser. No. 533,980, Sep. 20, 1983, abandoned.

[51] Int. Cl.[4] ..... C21D 1/00

[52] U.S. Cl. ..... 266/80; 266/87; 148/128

[58] Field of Search ..... 148/128; 266/87, 99, 266/78, 96, 80

[56] References Cited

U.S. PATENT DOCUMENTS

| | | | |
|---|---|---|---|
| 3,247,364 | 4/1966 | El Waziri | 148/128 |
| 3,868,094 | 2/1975 | Hovis | 266/87 |
| 4,004,138 | 1/1977 | Morooka et al. | 266/87 |
| 4,333,777 | 6/1982 | Takeuchi et al. | 148/128 |
| 4,373,364 | 2/1983 | Tanimoto et al. | 266/87 |

*Primary Examiner*—L. Dewayne Rutledge
*Assistant Examiner*—S. Kastler
*Attorney, Agent, or Firm*—Buell, Ziesenheim, Beck & Alstadt

[57] ABSTRACT

A furnace control for a reheating furnace or the like is disclosed. Desired material temperature parameters are established for at least one location within the furnace and predetermined heating rates are calculated to provide the desired temperatures. The furnace burners are set in accordance with the predetermined rates. Actual temperature readings of the material are taken in the furnace and compared to the desired temperatures. Revised heating rates are established on the basis of that comparison and the predetermined rates are replaced with the revised rates. The furnace burners are continuously adjusted and updated in accordance with the revised rates thereby increasing furnace efficiency and control.

4 Claims, 3 Drawing Figures

FURNACE CONTROLS

This application is a continuation-in-part of my copending U.S. application Ser. No. 533,980, filed Sept. 20, 1983, now abandoned.

The present invention relates to furnace controls for heating of plural independent blocks of material such as metal slabs, billets and the like which are sequentially transported through a furnace. More particularly, this invention relates to operating a material heating furnace in which predetermined heating rates are calculated to provide desired material temperature parameters at particular furnace locations, using direct measurement of the material for bias control, and continuously updating the heating rates to conform with actual working conditions.

Numerous furnace control systems have heretofore been proposed and used with varying degrees of success. U.S. Pat. No. 4,373,364, for example, discloses a furnace controlling method in which sensors are utilized to sense furnace temperature. The actual temperature of slabs within the furnace are determined or calculated by measuring temperatures of the zones in which the slab resides. If a slab is delayed in one zone of the furnace the slab rise pattern is modified and the temperature settings for the furnace are adjusted in accordance with the modified slab temperature rise pattern in order to minimize fuel consumption. A major problem with this system is that the initial and modified furnace temperature settings are all based on theoretical calculations and no means are provided for adjusting the theoretical model to the actual temperature of the slabs. The patent is not concerned with providing a means to correct or revise the theoretical model in accordance with actual material temperatures to provide maximum efficiency, but rather utilizes an existing model to adjust the furnace in response to changing conditions, such as changes in the flow of steel therethrough.

U.S. Pat. No. 4,333,777 discloses another method and apparatus in which sensors are used to measure the temperature distribution on a steel strip moving adjacent thereto. Heat from burners is selectively applied to the faces and edges of the strip at desired points to provide a uniform temperature across the strip. This invention does not in any way address or attempt to correct the cause of the unequal temperature distribution, but rather merely compensates for problems after they are identified.

The present invention achieves a more precise and accurate furnace control by initially setting the furnace heating rates in accordance with predetermined values which have been theoretically calculated to provide desired billet temperature parameters at various locations within the furnace. Actual temperature measurements are taken at these locations and the predetermined values are adjusted so that all subsequent billets or slabs passing through the furnace will have the desired temperature parameters at said locations. The predetermined theoretically calculated heating rates are then discarded in favor of the adjusted heating rate values based on actual temperature readings. With this method of feedback, it is possible to obtain substantial operating improvements by reducing burner settings to maintain even and consistent temperatures thereby resulting in significant heat and fuel savings.

I provide a system in which a furnace is divided into a plurality of different heating zones from side to side and between bottom and top. I prefer to provide a reheat furnace for reheating of steel billets prior to hot rolling. I further prefer to provide a predetermined program for reheating of the billets, to measure the temperature of the billets for compliance with the program and to revise and update the program in accordance with actual measured values of the metal.

In a typical billet reheating furnace, the billets are charged at the entry end of the furnace and pushed through in side-by-side relationship with the billets moving in a direction transverse to their axes. At the discharge end of the furnace the billet to be discharged is pushed axially from the side of the furnace and is advanced to the hot mill for rolling. The furnace may be divided into a bottom heating zone, a top heating zone and a soaking zone. The bottom heating zone may also include a preheat zone. Moreover, the furnace may be further divided into a series of parallel tracks through the bottom and top heating zones and the soaking zone.

A heating schedule including the predetermined heating rates which will provide desired billet temperature parameters at various locations within the furnace is computed for each grade of steel which may be passed through the furnace at different changing rates. The schedule is based upon known heat transfer equations and predicts temperature of the steel in the bottom heat zone, in the top heat zone and in the soaking zone. The schedules are entered into a computer or processor means which contols firing of the furnace.

As each billet exits from the bottom heat zone a direct surface temperature measurement of the steel is made using a radiation pyrometer which ignores radiation from the walls and the like. A further surface temperature measurement is made as the billet exits from the top heating zone. Still a further surface temperature measurement of the steel is made as each billet exits from the soaking zone to the mill. When a billet exits from the furnace the temperature profile along its length is measured.

For any particular operation, the program for the appropriate charging rate and grade of steel is selected. The direct steel measurements of the billets in the furnace are compared with the desired temperatures as entered into the computer program. If the actual measured temperatures differ from the desired temperature by more than a set amount, the firing rates of the related burners are adjusted up or down proportioned to the difference between the predicted temperature and the measured temperature.

The temperature profile along the length of each billet is measured as it exits from the furnace by measuring the temperature of the billet at various points along its length. If the temperature of one part, an end for example, is above or below the rest of the billet, the firing rate in that part of the furnace is adjusted relative to the firing rate in the remaining parts of the furnace.

The actual measured temperatures of the billet are stored and the actual billet temperature readings are continuously updated. If a sequence of readings shows that adjustment of the firing rate is necessary, the program is modified accordingly. Thus, the computer program for heat control is continuously updated and modified to adjust the furnace heating rates (burner rates) to bring the actual temperature of the billets leaving the bottom, top and soak zones of the furnace in accordance with the desired temperatures for such locations.

It is well known that in commercial operation of reheating furnaces production delays are inevitable. In some instances the delay will be "planned" resulting from an operator command. In other instances the delay may result from an unexpected equipment breakdown, a "cobble" in the hot mill, or the like. When a command for a delay occurs, either planned or unplanned, the firing rate will automatically be cut back. If a planned delay has been encountered the operator will enter the duration of the planned delay and a recovery time will be found in the computer program. If the delay is unplanned a warning will be given to the operator. If no response is made thereto the program will automatically go into a delay of predetermined time duration.

The operation and additional advantages of certain presently preferred embodiments of the present invention will be more fully understood from the following description of the invention and reference to the accompanying drawings in which.

Figure 1:
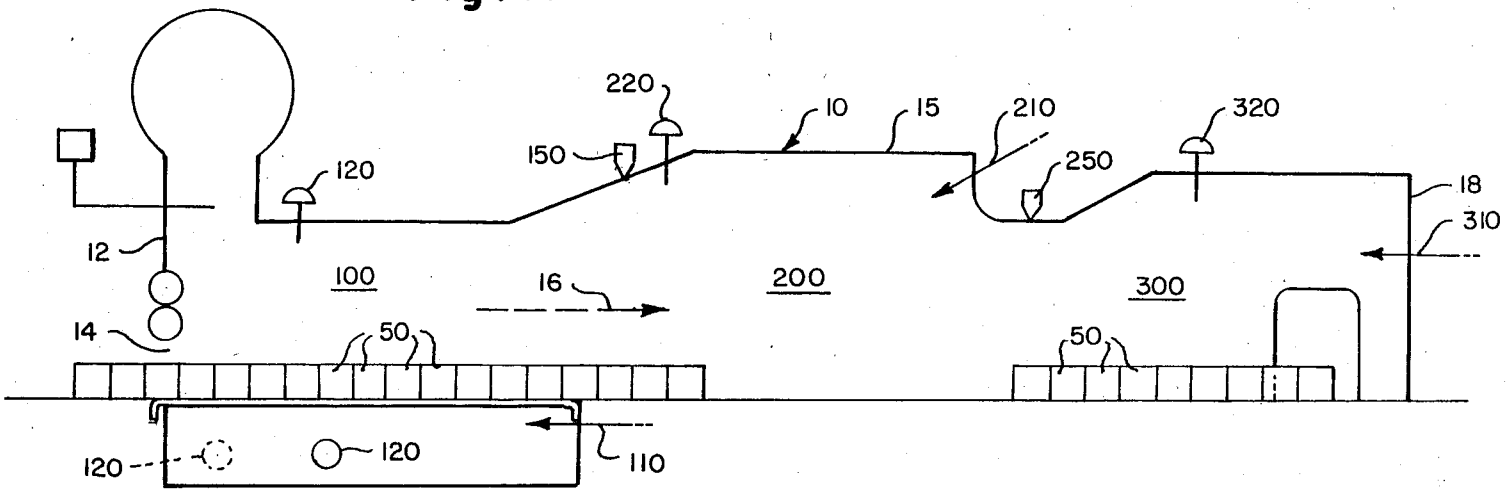
FIG. 1 is a longitudinal cross-sectional view in schematic form showing the configuration of typical variable rate billet reheat steel furnace adapted for use in accordance with the present invention.
Figure 2:
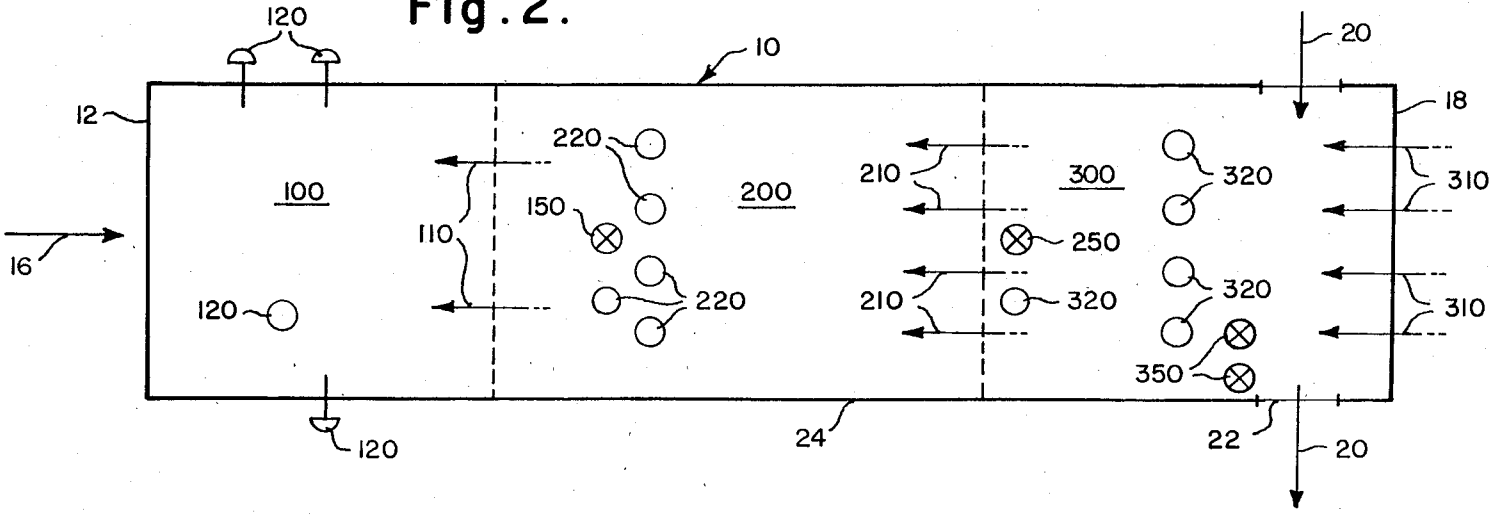
FIG. 2 is a top plan view in schematic form of the furnace of FIG. 1.

Referring specifically to FIGS. 1 and 2, a billet reheat furnace 10 is shown. Furnace 10 is divided generally into three zones referred to as a bottom heat zone 100, a top heat zone 200 and a soak zone 300. Billets 50 are charged at the entry end 12 of furnace 10 through opening 14 therein and are pushed through the furnace in side-by-side relationship with the billet moving in the direction of arrow 16 which is transverse to their axis. At the discharge end 18 of furnace 10, each billet 50 to be discharged is pushed axially in the direction of arrows 20 through opening 22 in the side 24 of the furnace and is advanced to the mill for rolling.

The bottom surface of billets 50 are heated within bottom zone 100 by burners 110. The top surfaces thereof are heated by burners 210 when billets 50 enter the top heat zone. Finally, the billets are brought to a substantially uniform temperature by side burners 310 within the soak zone 300. Within each zone a number of independently controlled burners are provided across the furnace. Proper adjustment of these burners results in a substantially uniform heating of billets.

Within the bottom heat zone 100, temperature sensor and control means 120 are utilized to monitor the furnace temperatures within zone 100 and/or to communicate with and control the firing of burners 110. It will be understood by those skilled in the art that a separate sensor is preferably provided for each burner to provide independent control of the localized areas affected by each burner. Likewise, sensor and control means 220 and 320 are provided to monitor the furnace temperatures in top heat zone 200 and soak zone 300 and to control the firing or heating rates of burners 210 and 310, respectively. Temperature sensor and control means 120, 220 and 320 preferably include thermocouples.

Radiation pyrometers such as, for example, the type sold under the registered trademark Ircon, are preferably provided at locations whereby a direct temperature measurement of the top surface of each billet 50 may be obtained as the billet exits the bottom heat zone 100 and top heat zone 200. Ircon 150, for example, is attached to ceiling 15 of furnace 10 at a location slightly within top heat zone 200. Likewise, Ircon 250 is attached to ceiling 15 slightly within soak zone 300, as shown. Additionally, Ircons 350 are preferably provided at a location just inside the furnace within soak zone 300 to measure the temperature of the billets as they leave furnace 10. Ircons 350 may be used to measure the top billet surface temperature and/or to determine the temperature profile of a billet by measuring the temperature thereof at various points along its length. It will be obvious to those skilled in the art that any number of Ircons may be provided at various other locations within and outside the furnace to provide additional information regarding the actual billet temperature at such other locations.

In the process of reheating steel whether it is to be a boom, billet or slab, heat is conducted toward the center from the surfaces exposed to it. In practice, it is difficult to expose all surfaces equally to the heating medium and as a result uneven heating is likely to occur causing undesired variations in the dimensions of the finished surface. The present invention, therefore, is directed to a process and apparatus by which predetermined furnace heating rates are continuously adjusted and updated based on a comparison of desired temperatures parameters and actual temperature measurements at various locations within the furnace.

Prior to the initial setting of the heating rates of the burners of furnace 10 for any particular charge, I prefer to establish the grade of steel and the size and the number of billets in the charge. Other information such as a sequence number to identify and track a particular billet, the length of the billets and the rolled size thereof may also be established. In situations where there are billets of more then one grade of steel in a particular charge, I prefer to establish a priority which causes the furnace heating rates to be set at appropriate rates for a preferred or chosen group or grade of billets. The chosen material is tracked through the furnace and heating adjustments are made to the chosen material. I further prefer to enter all of this information into a processor means which includes a computer and a computer program therefor.

The present invention also utilizes a collection of information and data referred to hereinafter as setup tables. These tables are theoretical models reflecting the solution of heat transfer and differential equations based on the physical design of the furnace and the chemical and physical properties of various steel grades. The setup tables certain desired temperature parameters which billets 50 should have at various target locations within furnace 10. These parameters may include, for example, a desired temperature or range of temperatures for the top and bottom surfaces and for a plurality of points therebetween for a particular charge of billets. The setup tables also contain calculated burner set points or heating rates for each of the top 100, bottom 200 and soak 300 zones for each grade of steel at a plurality of production rates. These heating rates will theoretically provide the desired billet temperature parameters at the target locations. The setup tables are also preferably inputted into the processor means which, together with the information regarding the grade and quantity of steel in a particular charge (production rate) allows for the calculation by the processor means of appropriate initial heating rates within each zone for that charge.

Figure 3:
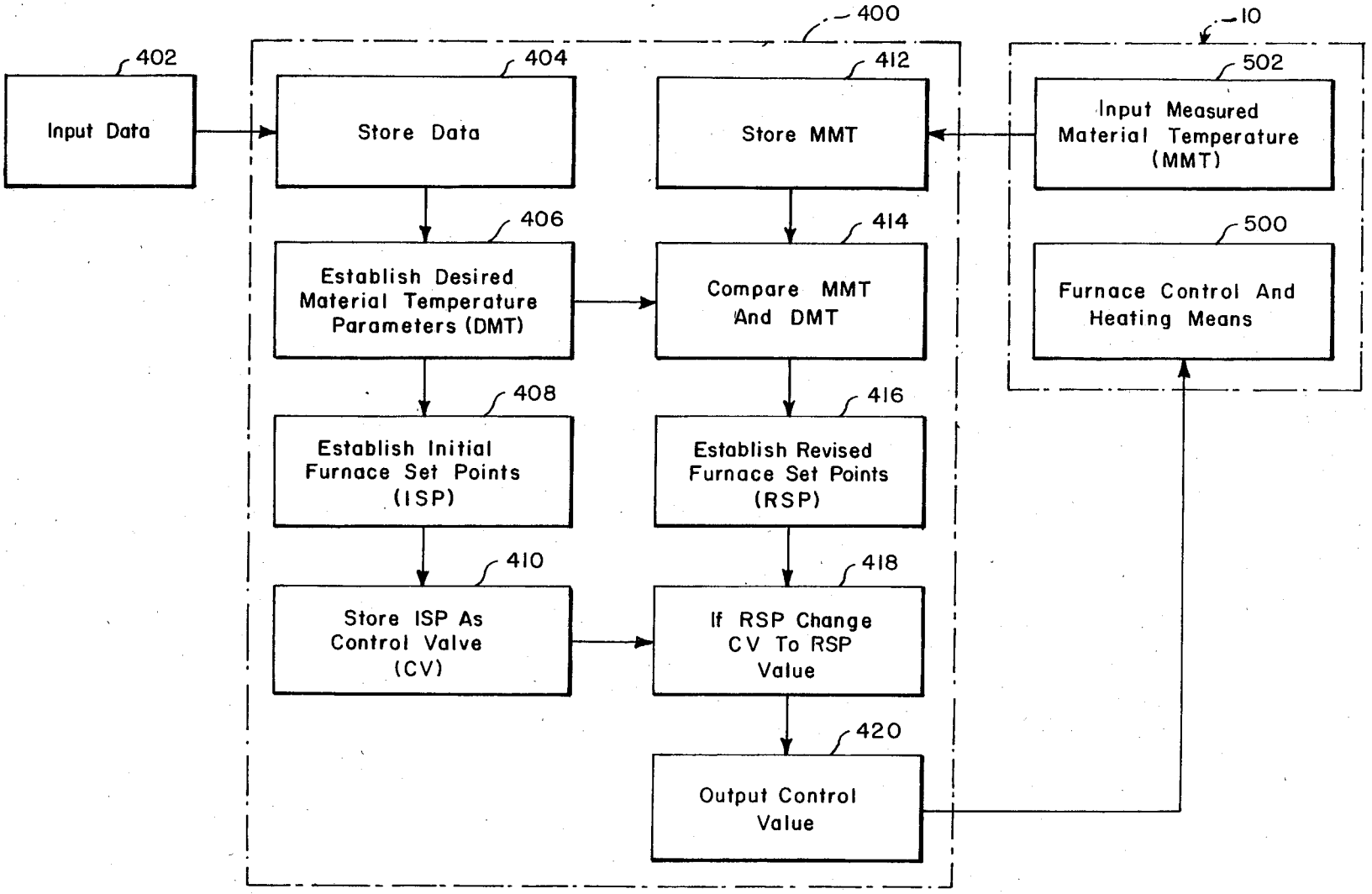
FIG. 3 is a block flow diagram illustrating generally the process of the present invention.

The preferred operation of the present invention will now be explained on reference to the block flow diagram shown in FIG. 3. The setup tables and information regarding a particular charge are entered into processor means 400 (blocks 402 and 404). Desired material temperature parameters are established and/or calculated (block 406) by processor means 400 for various target locations within the furnace. The processor means also calculates and/or establishes initial predicted furnace set points (heating rates) (block 408) for the furnace control and heating means (block 500) which will theoretically provide the desired material temperature parameters at the target locations within furnace 10 (block 502). The initial furnace set points are temporarily stored as the furnace control value in processor means 400 (block 410). The charge of billets is placed into the furnace and processor means 400 outputs the initial set points (blocks 418 and 420) to furnace control and heating means 500 until revised furnace set points are established thereby activating the furnace burners at appropriate initial heating rates.

As the billets pass by the target locations, actual measured material temperatures are taken and inputted and stored in processor means 400 (blocks 502 and 412). Processor means 400 compares the measured material temperature and the desired material temperature (block 414) and establishes revised furnace set points (blocks 416) which replace the initial furnace set points (block 418) as the control value which is outputted (block 420) to the furnace control and heating means (block 500). As more fully explained hereinafter, revised furnace set points are preferably only established when the measured material temperature does not fall within an appropriate range of desired temperature parameters.

Referring again to FIGS. 1 and 2, as the billets leave the bottom heating zone 100, Ircon 150 measures and communicates to the processor means the actual top surface temperature of the billets as they pass thereunder. The processor means preferably compares the actual measured top surface temperature with the desired valve therefor obtained from the setup tables and determines a magnitude and direction of error therebetween. The processor means adjusts a theoretically calculated valve for the bottom surface temperature by an amount equal to the determined error in the top surface measurement. The calculated bottom surface temperature is based on the predicted set points and is preferably included in the setup tables. The processor means determines the difference between the actual measured top surface temperature and the adjusted bottom surface temperature. If that difference is less than 200° F. the bottom zone of the furnace is considered to be too hot and the processor means adjusts the heating rate (burners 110) downwardly. If that difference is greater than 400° F. the bottom zone of the furnace is considered to be too cold and the processor means adjusts the heating rate upwardly. If the difference is between 200° F. and 400° F. the bottom zone is judged to be within an acceptable temperature range and the processor makes no adjustment.

As the billets move from top heat zone 200 into the soak zone 300 they pass under Ircon 250 which again measures and communicates to the processor means the actual top surface temperature of the billets. If the measured top surface temperature is within ±20° F. of the desired value at that location, the processor makes no adjustment of the heating rate in the top heat zone (burners 210). If the measured temperature is not within 20° F. of the desired top surface temperature, the heating rate for the top heat zone is accordingly adjusted upwardly or downwardly.

Likewise, as billets 50 exit furnace 10 they pass under and/or by Ircons 350. Again the processor receives and compares the measured and desired values for the surface temperature for each Ircon location and makes an adjustment in the heating rate in soak zone 300 (burners 310) only if the measured values are greater than ±20° F. of the desired values. It will be obvious to those skilled in the art that by providing a number of Ircons 350 along the path of an axial edge of the existing billets 50, that an actual temperature profile along the length of each billet may be measured and communicated to the processor means. This information allows the processsor to make individual adjustments of burners across the width of furnace 10 to provide greater uniformity in billets thereafter passing through the furnace.

It is to be understood that in each zone of the furnace, once the initially calculated burner set points (heating rates) are found not to provide the desired temperature parameters in the billets, the processor means not only adjusts the heating rates in accordance with the actual measured temperature but also replaces the initially calculated set points in the setup tables with updated or revised heating rates therefor which will, at all future times, be utilized as the initial set points when identical or similar furnace and charge conditions are present. With the present invention, therefore, the furnace set points or heating rates are constantly being updated by the processor means based on a comparison of the actual temperature measurements obtained and the desired temperature parameters. With this type of feedback, in addition to allowing for ever increasing accurate furnace settings, it is contemplated that errors in the theoretical model may be identified and corrected allowing for even greater efficiency and control of the reheat process.

While I have described certain presently preferred embodiments of my invention, it is to be understood that the invention is not limited thereto and may be otherwise variously practiced within the scope of the following claims.

I claim:

1. A furnace control for a furnace for heating a material having at least first and second adjacent independently temperature controlled heating zones through which blocks of material to be heated are consecutively transported in series comprising:

(a) surface temperature sensing means mounted on the furnace in said second zone to directly measure the surface temperature of said material as it enters said second zone from said first zone; and (b) means responsive to said temperature sensing means for controlling the furnace temperature in said first zone.

2. The method of heating material in a furnace having at least first and second independently controlled heating zones through which blocks of material are consecutively transported in series comprising the steps of:

(a) establishing predetermined heating rates for said first zone calculated to provide a desired material surface temperature as the material enters said second zone from said first zone, (b) adjusting the furnace temperature in said first zone in accordance with said predetermined rates;

(c) measuring the surface temperature of the material as it enters said second zone; and (d) adjusting the furnace temperature of said first zone responsive to surface temperature measurements taken in said second zone so as to produce said desired material surface temperature as the material enters said second zone.

3. The method of claim 2 further comprising the step of replacing the predetermined heating rates with revised heating rates based on a sequence of said surface temperature measurements.

4. The method of claim 2 further comprising:

(a) providing blocks of at least two different types of material in said first furnace zone;

(b) choosing a single type of material as a priority material in the first zone for which predetermined heating rates are established;

(c) establishing desired material temperature parameters for the priority material type of said chosen material;

(d) tracking movement of said priority material through the furnace; and (e) measuring the surface temperature of the priority material as it enters the second zone.

* * * * *

UNITED STATES PATENT AND TRADEMARK OFFICE

CERTIFICATE OF CORRECTION

PATENT NO. : 4,606,529

DATED : August 19, 1986

INVENTOR(S) : CHARLES A. TOOCH

It is certified that error appears in the above-identified patent and that said Letters Patent is hereby corrected as shown below:

Column 2, line 29, change "contols" to --controls--.

Column 6, claim 2, line 61, after zone delete "," and insert --;--.

Signed and Sealed this

Fourth Day of November, 1986

[SEAL]

*Attest:*

DONALD J. QUIGG

*Attesting Officer*

*Commissioner of Patents and Trademarks*